United States Patent [19]

Hayes

[11] 4,445,280

[45] May 1, 1984

[54] BRAKE FOR DRAFTING PARALLEL

[76] Inventor: Jess W. Hayes, 9208 Farmington Dr., Richmond, Va. 23229

[21] Appl. No.: 431,208

[22] Filed: Sep. 30, 1982

[51] Int. Cl.[3] ..... B43L 5/00; B43L 13/00

[52] U.S. Cl. ..... 33/443; 33/444; 188/65.2

[58] Field of Search ..... 33/443, 444, 445, 446, 33/430, 437; 188/65.1, 65.2

[56] References Cited

U.S. PATENT DOCUMENTS

| | | | |
|---|---|---|---|
| 533,387 | 1/1895 | Vielhaber | 33/444 |
| 1,369,263 | 2/1921 | Parvin | 33/437 |
| 1,419,354 | 6/1922 | Boon | 33/446 |
| 2,520,021 | 8/1950 | Veyret et al. | 33/444 |
| 2,909,840 | 10/1959 | Rodgers | 188/65.1 |
| 3,911,585 | 10/1975 | McNeil | 33/443 |

FOREIGN PATENT DOCUMENTS

| | | | |
|---|---|---|---|
| 987547 | 8/1951 | France | 33/444 |
| 104161 | 3/1942 | Sweden | 33/443 |
| 181835 | 1/1936 | Switzerland | 33/430 |

*Primary Examiner*—Richard R. Stearns
*Attorney, Agent, or Firm*—Norman B. Rainer

[57] ABSTRACT

A braking assembly adapted for attachment to the extremity of a drafting parallel and to the underlying drafting table utilizes a stationary tensioned strand which engages locking means on the drafting parallel. The braking effect is secured by depressing a movable arm which urges a resilient pad into gripping engagement of the strand.

5 Claims, 3 Drawing Figures

BRAKE FOR DRAFTING PARALLEL

BACKGROUND OF THE INVENTION

This invention relates to a brake device for a drafting parallel, and more particularly to a manually adjustable brake device capable of preventing unwanted movement of a drafting parallel resting upon the surface of a tiltable drafting table.

On certain types of draftsman's tables which are adapted to be inclined at various angles, a drafting parallel is provided which lies flat against the working surface of the table and is adjustably positionable thereon by sliding engagement with guide means associated with at least one side edge of said surface and perpendicular to said drafting parallel. The drafting parallel is mechanically coupled to said guide means with the aid of a continuous cable which traverses said drafting parallel in two passes in close parallel adjacency. The cables are generally housed between a lower member of said drafting parallel which lies flat against the table surface, and a cover which extends along the upper surface of said lower member.

A commonly encountered problem with a drafting parallel of the aforesaid nature is that it tends to fall to lower positions on the table surface due to the effect of gravity, said falling being more pronounced with steeper inclinations of said table surface.

Although brake devices have been disclosed for preventing the falling motion of the drafting parallel, such devices have been either of complex and expensive design, or difficult to manipulate in the course of usual drafting manipulations. Other brake devices require structural modification of the parallel to facilitate installation. Although such devices may be incorporated into a parallel during the manufacture thereof in a factory, they are not easily applied to existing parallels.

It is accordingly an object of the present invention to provide a brake device of simple construction and facile operation which will controllably lock the position of a drafting parallel on a tiltable drafting table.

It is another object to provide a device of the aforesaid nature which can be readily installed onto a drafting parallel of common design without structural modification thereof.

It is a still further object of this invention to provide a device of the aforesaid nature capable of manual operation and of a size sufficiently small to avoid impairment of the general functionality of said drafting parallel.

These objects and other objects and advantages of the invention will be apparent from the following description.

SUMMARY OF THE INVENTION

The above and other beneficial objects and advantages are accomplished in accordance with the present invention by an improved brake assembly which comprises a base member, the underside of which possesses a flat central region bracketed by retainer shoulders which extend below said flat region and are adapted to engage the straight edges of a drafting parallel. A holding arm is pivotably attached to the upper surface of the base member in a manner to permit swinging motion of said holding arm in an arc perpendicular to said base member. A threaded locking bolt penetrates an aperture in said holding arm. The lower extremity of said bolt threadably engages said base member perpendicularly thereto and preferably centered therein.

Adjustment means are attached to said locking bolt adjacent the upper extremity thereof and positioned in sliding abutment with the upper surface of said holding arm. Said adjustment means facilitates manual rotative movement of said locking bolt, and imparts downward force to said holding arm. The underside of the free extremity of the holding arm is provided with a resilient pad.

A pair of spaced-apart guides are secured to the upper surface of the base member in a disposition to bracket said holding arm. A wire cable freely passes through said guides. Each extremity of the cable is provided with anchor means adapted to fixedly engage the working surface of the drafting table. A coil spring is associated with at least one extremity of said cable.

In installation, the cable is affixed to the drafting table in an orientation perpendicular to the drafting parallel adjacent an extremity thereof, and the base member is attached to said extremity of the parallel. In operation, the position of the parallel is locked by tightening said adjustment means, which causes the resilient pad to press upon the cable positioned thereunder, said cable being thereby gripped between said pad and the upper surface of the base member. When the cable is gripped in said manner, movement of the parallel is prevented.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawings.

DESCRIPTION OF A PREFERRED EMBODIMENT

Figure 1:
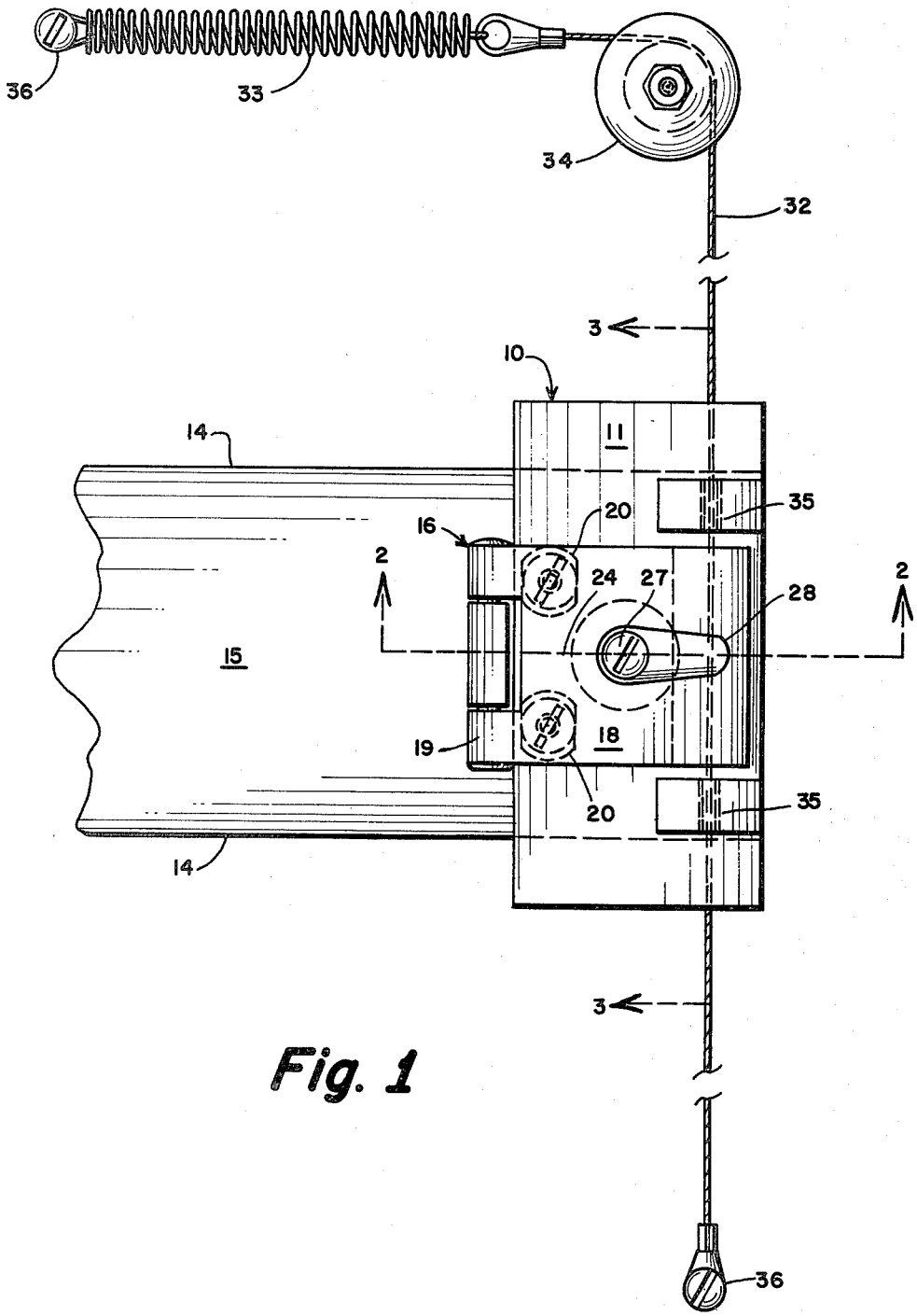
FIG. 1 is a top plan view of an embodiment of the brake assembly of this invention in operative association with a drafting parallel on a table.
Figure 2:
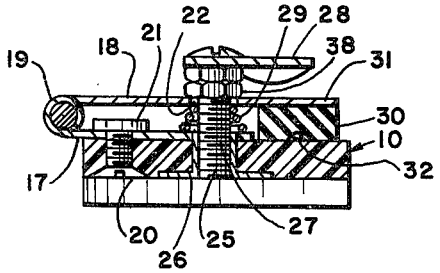
FIG. 2 is a sectional view taken along the line 2—2 of FIG. 1.
Figure 3:
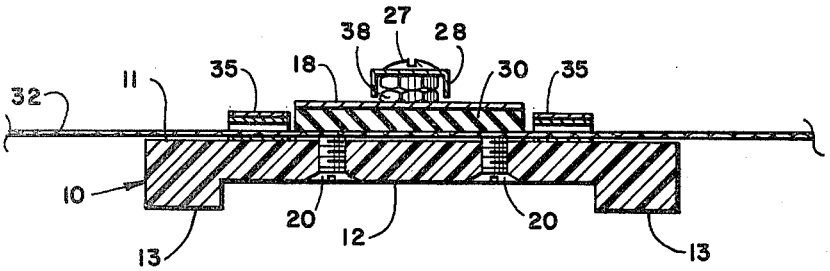
FIG. 3 is a sectional view taken along the line 3—3 of FIG. 1.

Referring to FIGS. 1–3, a brake assembly of the present invention is shown comprised of base member 10 of generally rectangular outer periphery having a substantially flat upper surface 11, and a lower surface having a flat central portion 12 bounded by opposed straight parallel retainer shoulders 13 adapted to engage the opposed edges 14 of drafting parallel 15. A pivoted hasp 16 comprised of lower arm 17, upper arm 18 and pivot hinge 19 is associated with base member 10 in a manner whereby lower arm 17 is rigidly secured to upper surface 11 by threaded bolts 20 and interactive threaded nuts 21, said bolts passing through aligned holes in said base member and in lower arm 17. The pivot hinge is disposed to be parallel with and adjacent one longitudinal edge of the base member. By virtue of the aforesaid mode of attachment of the hasp to the base member, upper arm 18 enjoys swinging movement about pivot hinge 19 in an arc perpendicular to said base member.

Vertically aligned circular apertures 22 and 23 are provided in arms 18 and 17 respectively, said apertures being positioned on the lateral midpoint axis 24 of said base member. A circular channel 25 perpendicularly penetrates base member 10 in alignment with apertures 22 and 23. A threaded fitting 26 is fixedly inserted within channel 25. A threaded bolt 27 passes freely through apertures 22 and 23 and threadably engages fitting 26. The upper extremity of bolt 27 is provided with fixedly attached lever means 28 which functions to facilitate turning movement of bolt 27 and attendant application of controlled downward force to nuts 38 in sliding abutment with upper arm 18. Threaded fitting 26, bolt 27, lever 28 and nuts 38 collectively constitute holding means adapted to force arm 18 downwardly toward base 10. Other equivalent holding means may be utilized to serve the same result. A coil spring 29 is positioned on bolt 27 between upper arm 18 and lower arm 17, its purpose being to resist the downward force applied by lever means 28 upon upper arm 18. An elongated resilient pad 30 is affixed to the underside of upper arm 18 adjacent its free extremity 31, the purpose of said pad to be made clear hereinafter.

A strand 32 preferably of wire is provided as part of the brake assembly of this invention. The strand, which is flexible but non-elongatable under conditions of use, may be 0.040 piano wire, braided picture wire, aircraft cable, or equivalent strong, thin, durable material. One extremity of the strand is adapted to be anchored to the drafting table by a wood screw 36, or other fastening means such as clamps. The opposite extremity of the strand is joined to one end of coil spring 33. The opposite end of said coil spring is adapted to be anchored to the drafting table. A pulley 34 mounted on the drafting table, may optionally be emplaced so as to interact with strand 32 adjacent the spring-containing extremity.

Two opposed guide tubes 35 are mounted in spaced-apart coaxial alignment upon upper surface 11 of base member 10, and strand 32 is caused to pass through said tubes. The placement of said tubes is such as to facilitate intervening positioning of upper arm 18, and the embracement of strand 32 by pad 30.

In operation, the base member will be attached as by adhesives or other means to the free extremity of drafting parallel 15. The ends of strand 32 will be affixed to the drafting table so as to cause the strand to be taut and perpendicular to the drafting parallel as it passes through guide tubes 35. When it is desired to fix or brake the position of the parallel, bolt 27 will be tightened by means of lever means 28 which imparts downward force to pivoted upper arm 18. Said downward force causes pad 30 to embrace strand 32 by abutting interaction with the upper surface of the base member, whereby the drafting parallel becomes temporarily fixed to the strand. By releasing the force upon upper arm 18, the strand is disengaged, and the drafting parallel is once again free to move.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A brake assembly for use with a drafting parallel resting on an inclined drafting table comprising:
   (a) a base member of substantially rectangular outer perimeter having a flat upper surface and an underside having a flat central region bounded by straight parallel retainer shoulders extending below said flat region and adapted to engage the straight edges of said drafting parallel,
   (b) an arm, one extremity of which is attached to the upper surface of said base member in a manner to permit motion of said arm in an arc perpendicular to said base member, the free end of said arm being adapted to apply downward force upon said base member,
   (c) a resilient pad affixed to the underside of said arm adjacent the free end thereof,
   (d) holding means adapted to retain said arm in a position downwardly forced upon said base member,
   (e) a pair of guides secured to the upper surface of said base member in coaxial alignment and disposed on either side of said arm in linear alignment with said resilient pad,
   (f) a strong thin substantially non-elongated strand, one end of which is adapted to be secured to said table, the opposite end being joined to a coil spring adapted to be secured to said table, said strand passing through said pair of guides,
   (g) whereby, when the flat underside of the base member is attached to the extremity of said drafting parallel, and said strand is affixed to said table to form a taut straight line passing through said guides, downward movement of said arm and retention thereof by said holding means causes said strand to be gripped between said resilient pad and the upper surface of said base member, thereby preventing movement of said drafting parallel.

2. The brake assembly of claim 1 wherein said arm is pivotably attached to the upper surface of said base member.

3. The brake assembly of claim 2 wherein said holding means is comprised of a threaded rod which passes freely through an aperture in said arm and anchors in said base assembly, and a retainer which threadably engages said threaded rod above said arm.

4. The brake assembly of claim 3 wherein a coil spring is positioned upon said threaded rod between said base member and the underside of said arm.

5. The brake assembly of claim 3 wherein said arm is the upper member of a hasp, the lower member of said hasp being fixedly attached to said base member.

* * * * *